US009322253B2

(12) United States Patent
Barry et al.

(10) Patent No.: US 9,322,253 B2
(45) Date of Patent: Apr. 26, 2016

(54) METHOD FOR PRODUCTION OF HYDROCARBONS USING CAVERNS

(71) Applicants: Michael D. Barry, The Woodlands, TX (US); James S. Brown, Sugar Land, TX (US); Daniel P. Leta, Flemington, NJ (US); Moses K. Minta, Missouri City, TX (US); Scott M. Whitney, Spring, TX (US); Paul L. Tanaka, Sugar Land, TX (US)

(72) Inventors: Michael D. Barry, The Woodlands, TX (US); James S. Brown, Sugar Land, TX (US); Daniel P. Leta, Flemington, NJ (US); Moses K. Minta, Missouri City, TX (US); Scott M. Whitney, Spring, TX (US); Paul L. Tanaka, Sugar Land, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 14/366,659

(22) PCT Filed: Nov. 16, 2012

(86) PCT No.: PCT/US2012/065662

§ 371 (c)(1),
(2) Date: Jun. 18, 2014

(87) PCT Pub. No.: WO2013/103448

PCT Pub. Date: Jul. 11, 2013

(65) Prior Publication Data

US 2014/0338921 A1 Nov. 20, 2014

Related U.S. Application Data

(60) Provisional application No. 61/582,600, filed on Jan. 3, 2012.

(51) Int. Cl.
*E21B 43/00* (2006.01)
*E21B 43/12* (2006.01)
(Continued)

(52) U.S. Cl.
CPC ..... *E21B 43/16* (2013.01); *E21B 43/385* (2013.01)

(58) Field of Classification Search
None
See application file for complete search history.

(56) References Cited

U.S. PATENT DOCUMENTS 3,066,732 A 12/1962 McEver ..... 166/7
3,438,203 A 4/1969 Lamb et al. ..... 61/0.5
(Continued)

FOREIGN PATENT DOCUMENTS

EP 0525287 2/1993 ..... B65G 5/00
RU 2451251 5/2012 ..... F25J 3/00
(Continued)

OTHER PUBLICATIONS

Chuang, K. T. et al. (2000) "Tray Columns: Design," *Academic Press*, pp. 1135-1140. http://razifar.com/cariboost_files/Tray_20Columns_20Design.pdf.
(Continued)

*Primary Examiner* — Matthew R Buck
*Assistant Examiner* — Douglas S Wood
(74) *Attorney, Agent, or Firm* — ExxonMobil Upstream Research Company Law Department

(57) ABSTRACT

Embodiments described herein provide a system and methods for the production of hydrocarbons. The method includes flowing a stream directly from a hydrocarbon reservoir to a cavern and performing a phase separation of the stream within the cavern to form an aqueous phase and an organic phase. The method also includes flowing at least a portion of the aqueous phase or the organic phase, or both, directly from the cavern to a subsurface location and offloading at least a portion of the organic phase from the cavern to a surface.

33 Claims, 5 Drawing Sheets

(51) Int. Cl.

| | |
|---|---|
| ***E21B 43/14*** | (2006.01) |
| ***E21B 43/16*** | (2006.01) |
| ***E21B 43/38*** | (2006.01) |

(56) References Cited

U.S. PATENT DOCUMENTS

| | | | | |
|---|---|---|---|---|
| 3,768,726 | A | 10/1973 | Hale et al. | 233/16 |
| 3,807,501 | A | 4/1974 | Kurtis et al. | 166/314 |
| 4,016,930 | A | 4/1977 | Arnold | 166/266 |
| 4,187,088 | A | 2/1980 | Hodgson | 55/169 |
| 4,365,978 | A | 12/1982 | Scott | 55/47 |
| 4,661,127 | A | 4/1987 | Huntley | 55/174 |
| 4,691,524 | A | 9/1987 | Holscher | 60/652 |
| 5,129,759 | A | 7/1992 | Bishop | 405/59 |
| 5,302,294 | A | 4/1994 | Schubert et al. | 210/702 |
| 5,394,943 | A | 3/1995 | Harrington | 166/373 |
| 5,407,605 | A | 4/1995 | Resetarits et al. | 261/98 |
| 5,451,349 | A | 9/1995 | Kingsley | 261/91 |
| 5,511,905 | A * | 4/1996 | Bishop | B36G 5/00 166/57 |
| 5,752,538 | A | 5/1998 | Billingham et al. | 137/1 |
| 5,803,161 | A | 9/1998 | Wahle et al. | 165/104.21 |
| 5,857,519 | A * | 1/1999 | Bowlin | E21B 43/121 166/105.6 |
| 5,984,282 | A | 11/1999 | Armstrong et al. | 261/112.2 |
| 6,086,055 | A | 7/2000 | Armstrong et al. | 261/96 |
| 6,149,136 | A | 11/2000 | Armstrong et al. | 261/19 |
| 6,190,543 | B1 | 2/2001 | Christiansen | 210/87 |
| 6,197,095 | B1 | 3/2001 | Ditria et al. | 95/248 |
| 6,245,955 | B1 | 6/2001 | Smith | 585/15 |
| 6,260,619 | B1 | 7/2001 | Svedeman et al. | 166/265 |
| 6,367,547 | B1 * | 4/2002 | Towers | E21B 43/385 166/105.5 |
| 6,397,630 | B1 | 6/2002 | Fraysse et al. | 62/643 |
| 6,564,865 | B1 | 5/2003 | Brady et al. | 166/105.3 |
| 6,820,696 | B2 * | 11/2004 | Bergman | B65G 5/00 166/369 |
| 7,140,441 | B2 | 11/2006 | Hauge et al. | 166/357 |
| 7,156,579 | B2 | 1/2007 | Castle et al. | 405/58 |
| 7,322,387 | B2 * | 1/2008 | Landry | F17C 7/04 141/11 |
| 7,490,671 | B2 | 2/2009 | Gramme et al. | 166/357 |
| 7,516,794 | B2 | 4/2009 | Gramme et al. | 166/357 |
| 7,554,223 | B1 | 6/2009 | Kay | 310/11 |
| 7,730,942 | B2 | 6/2010 | Gramme et al. | 166/245 |
| 7,854,849 | B2 * | 12/2010 | Wang | B01D 17/0214 210/744 |
| 7,918,283 | B2 | 4/2011 | Balkanyi et al. | 166/344 |
| 2004/0020238 | A1 | 2/2004 | Kalbassi et al. | 62/617 |
| 2004/0109538 | A1 | 6/2004 | McCarthy, Jr. | 378/141 |
| 2006/0032242 | A1 | 2/2006 | TeGrotenhuis et al. | 62/93 |
| 2006/0162553 | A1 | 7/2006 | Esparza et al. | 95/43 |
| 2008/0017594 | A1 | 1/2008 | Sarshar et al. | 210/787 |
| 2008/0272059 | A1 | 11/2008 | Chieng et al. | 210/744 |
| 2009/0013697 | A1 | 1/2009 | Landry et al. | 62/53.1 |
| 2009/0139938 | A1 | 6/2009 | Larnholm et al. | 210/788 |
| 2009/0151914 | A1 | 6/2009 | Mostofi-Ashtiani | 165/158 |
| 2009/0242490 | A1 | 10/2009 | Hopper | 210/723 |
| 2009/0309408 | A1 | 12/2009 | Bishop | 299/5 |
| 2010/0012325 | A1 | 1/2010 | Friedemann | 166/335 |
| 2010/0180769 | A1 | 7/2010 | Grenstad et al. | 95/260 |
| 2010/0212492 | A1 | 8/2010 | Miotto et al. | 95/22 |
| 2010/0243208 | A1 | 9/2010 | Kar et al. | 165/96 |
| 2010/0252227 | A1 | 10/2010 | Sten-Halvorsen et al. | 165/45 |
| 2010/0276821 | A1 | 11/2010 | Lee et al. | 261/79.1 |
| 2011/0072975 | A1 | 3/2011 | Aarebrot et al. | 96/157 |
| 2011/0100589 | A1 | 5/2011 | Van Der Rest | 165/45 |
| 2011/0209446 | A1 | 9/2011 | Kayat et al. | 55/322 |
| 2012/0091711 | A1 | 4/2012 | Badger | 290/43 |

FOREIGN PATENT DOCUMENTS

| | | | |
|---|---|---|---|
| WO | WO00/36270 | 6/2000 | E21B 43/20 |
| WO | WO03/091133 | 11/2003 | E21B 43/28 |
| WO | WO2004/007908 | 1/2004 | E21B 43/34 |
| WO | WO2006/010765 | 2/2006 | B01D 19/00 |
| WO | WO2010/110676 | 9/2010 | E21B 37/00 |
| WO | WO2010/117265 | 10/2010 | E21B 43/34 |
| WO | WO2011/093945 | 8/2011 | E21B 43/30 |
| WO | WO2013/043354 | 3/2013 | C10G 1/04 |
| WO | WO2014/018148 | 1/2014 | B01D 45/00 |
| WO | WO2014/058480 | 4/2014 | E21B 43/36 |
| WO | WO2014/070352 | 5/2014 | B01D 3/14 |

OTHER PUBLICATIONS

Eriksen, H. (2010) "Development of Calculation Model for Heat Exchangers in Subsea Systems," *Norwegian Univ. of Sci. and Tech.*, 124 pgs.

Hannisdal, A. et al. (2012) "Compact Separation Technologies and their Applicability for Subsea Development in Deep Water," *OTC Paper 23223*, Apr. 30-May 3, 2012, 12 pgs. http://asme-ipti.org/files/1841/.

Sinker, A. et al. (1997) "Applying the Compact Separation Methodology to Heavy Oil Separation," *Krebs Petroleum Tech. Ltd.*, Sep. 29-30, 1997, Aberdeen, UK, 17 pgs.

* cited by examiner

500

METHOD FOR PRODUCTION OF HYDROCARBONS USING CAVERNS

CROSS-REFERENCE TO RELATED APPLICATION

This application is the National Stage of International Application No. PCT/US2012/065662, filed Nov. 16, 2012, which claims the priority benefit of U.S. Provisional Patent Application No. 61/582,600 filed Jan. 3, 2012 entitled METHOD FOR PRODUCTION OF HYDROCARBONS USING CAVERNS, the entirety of which is incorporated by reference herein.

FIELD OF THE INVENTION

Exemplary embodiments of the subject innovation relate to the subsurface production, storage, and offloading of hydrocarbons using in-field caverns.

BACKGROUND

Oil and natural gas that is obtained from oil wells may be stored in an underground oil and natural gas storage facility. There are three general types of underground oil and natural gas storage facilities, including aquifers, depleted oil or gas field reservoirs, and caverns formed in salt or carbonate formations. These underground facilities are characterized primarily by their capacity, i.e., the amount of oil or natural gas that may be held in the facility, and their deliverability, i.e., the rate at which the oil or natural gas within the facility may be withdrawn.

Salt caverns are typically created by drilling a well into a salt formation, e.g., a salt dome or salt bed, and using water to dissolve and extract salt from the salt formation, leaving a large empty space, or cavern, behind. This is known as "salt cavern leaching." While salt caverns tend to be costly compared to aquifers and reservoirs, they also have very high deliverability, i.e., withdrawal rates, and injection rates. In addition, the walls of a salt cavern have a high degree of strength and resilience to degradation and are essentially impermeable, allowing little oil or natural gas to escape from the facility unless purposefully extracted. Salt cavern storage facilities are usually only about one hundredth of the size of aquifer and reservoir storage facilities, averaging about three hundred to six hundred feet in diameter and two thousand to three thousand feet in height. Accordingly, the capacity of salt caverns may range between around one million barrels to twenty million barrels of oil and natural gas.

In addition to storage considerations, the processing and offloading of the oil and natural gas is also of significant importance. Currently, Floating Production, Storage, Offloading (FPSO) units are often used to meet these demands for offshore environments. FPSOs are floating vessels that are used by the oil industry for the production and storage of oil and natural gas from nearby platforms until the oil and natural gas may be offloaded onto a tanker or ship, or transported through a pipeline. However, the high cost of such surface processing, storage, and offloading equipment limits the ability to efficiently monetize resources, especially in remote or challenging environments, such as Arctic or deepwater developments. For example, in some cases, the majority of the total cost of development may be used for the high capital and operating costs of the facility. Accordingly, a number of research studies have focused on alternate techniques for providing processing and storage facilities.

U.S. Patent Application Publication No. 2009/0013697 by Charles, et al., discloses a method and system for simultaneous underground cavern development and fluid storage. The method and system are directed to the creation of an integrated energy hub that is capable of bringing together different aspects of hydrocarbon and other fluid product movement under controlled conditions. The method and system may be applicable to the reception, storage, processing, collection and transmission downstream of hydrocarbons or other fluid products. The fluid product input to the energy hub may include natural gas and crude oil from a pipeline or a carrier, liquefied natural gas (LNG) from a carrier, compressed natural gas (CNG) from a carrier, and carrier-regassed LNG, as well as other products from a pipeline or a carrier. Storage of the fluid products may be above surface, in salt caverns, or in subterranean formations and cavities. Transmission of the fluid downstream may be carried out by a vessel or other type of carrier, or by means of a pipeline system. In addition, low-temperature fluids may be offloaded and sent to an energy hub surface holding tank, then pumped to energy hub vaporizers and sent to underground storage or distribution.

U.S. Pat. No. 5,129,759 to Bishop discloses an offshore storage facility and terminal. The offshore storage facility and terminal includes a number of underground caverns, an offshore platform that includes a hydrocarbon pipeline extending into each of the caverns, a flow line extending from the platform to single point moorings for connection to off-loading or loading supertankers, a displacing fluid pipeline extending between the salt caverns and a subsea reservoir, and a shore pipeline extending from the platform to shore. As hydrocarbons are off-loaded from the supertanker, a portion of the hydrocarbon stream is directed to the shore pipeline, while the rest is directed to the hydrocarbon pipelines into the underground caverns. As the hydrocarbons flow into the caverns, immiscible fluid is displaced into the displacing fluid pipeline and the reservoir. Subsequently, as hydrocarbons are removed from the underground caverns, the immiscible fluid is pumped from the reservoir into the underground caverns. The underground cavern may thus be used as both surge storage for off-loading supertankers and as long-term storage for hydrocarbons.

International Patent Publication No. WO2000/036270 by Siegfried, et al., discloses a system and method for the transport, storage, and processing of hydrocarbons. The method may be used to form a storage cavern associated with a petroleum well by leaching salt from a salt-bearing formation. The method may also be used for the production of petroleum from a petroleum-bearing formation, which involves connecting a cavern in a salt formation to the petroleum-bearing formation and maintaining the pressure in the cavern at a predetermined pressure to cause a predetermined flow rate of petroleum from the formation into the cavern. Further, the method may be used for the production of petroleum from the petroleum-bearing formation by drilling a single bore hole that connects the surface, the petroleum bearing-formation, and the salt-bearing formation. Thereafter, the salt may be leached from the salt-bearing formation to form a cavern, the petroleum-bearing formation may be used to produce petroleum, and the pressure in the cavern may be maintained at a predetermined level to cause petroleum to flow into the cavern. In addition, a system for producing oil may be created. The system may include a wellbore with an opening that connects a petroleum-bearing formation and a cavern. The system may also include a displacement conduit for the injection or removal of displacement fluid into the cavern.

U.S. Pat. No. 3,438,203 to Lamb, et al., discloses a method for the removal of hydrocarbons from salt caverns. The method involves removing oil and gas hydrocarbons from underground salt caverns by flowing oil and gas into a first cavern containing brine and storing the fluids until the oil, gas, and brine separate. The gas phase may then be removed through a main gas stream to shore, while the oil may be flowed into a second cavern containing brine by utilizing the accumulated pressure within the first cavern. The gas may be diverted from the main gas stream into a third cavern containing brine until the brine is displaced by the gas pressure and flowed into the second cavern, thereby displacing the oil within the second cavern. The oil may then be flowed to a loading zone.

U.S. Pat. No. 6,820,696 to Bergman, et al., discloses a method and system for the production of petroleum using a salt cavern. The method involves drilling a wellbore, wherein the surface is in fluid communication with an oil-bearing and a salt-bearing formation. A salt cavern may be formed by leaching salt from the salt-bearing formation, while the oil-bearing formation may be prepared for production. The pressure in the salt cavern may be maintained below the pressure in the oil-bearing formation in order to allow for the collection of oil in the salt cavern. Periodically, oil may be displaced from the salt cavern to the surface by injecting a fluid into the salt cavern.

However, the techniques above fail to disclose systems or methods for the disposal of waste from a salt cavern without causing a surface footprint. Rather, all of the techniques above rely on the removal of waste products, such as water, brine, or excess hydrocarbons, from the salt cavern to the surface for processing and subsequent disposal. Thus, there is a need for new and improved systems and methods which effectively deal with the problem of waste products, while reducing the cost of operation and the effect on the environment.

Moreover, the techniques above also fail to disclose the full separation of a hydrocarbon stream within an underground formation, such as a salt cavern. Instead, a method for removing a bulk stream of gas or oil from a salt cavern is disclosed. However, the utilized separation methods may not allow for the clean separation of multiple phases within a salt cavern. Therefore, new and improved methods for separating hydrocarbon streams within underground formations are also needed.

SUMMARY

An embodiment provides a method for the production of hydrocarbons. The method includes flowing a stream directly from a hydrocarbon reservoir to a cavern and performing a phase separation of the stream within the cavern to form an aqueous phase and an organic phase. The method also includes flowing at least a portion of the aqueous phase or the organic phase, or both, directly from the cavern to a subsurface location and offloading at least a portion of the organic phase from the cavern to a surface.

Another embodiment provides a system for the production of hydrocarbons. The system includes a cavern configured to affect a phase separation and a hydrocarbon reservoir linked to the cavern directly through a subsurface. The system also includes a reinjection system configured to reinject a gas stream into the hydrocarbon reservoir from the cavern directly through the subsurface and an injection system configured to inject an aqueous stream from the cavern into an aquifer directly through the subsurface. The system further includes a coupling configured to allow offloading of at least a portion of an organic phase from the cavern to a transportation system.

Another embodiment provides a method for harvesting hydrocarbons. The method includes flowing a hydrocarbon stream from a hydrocarbon reservoir directly to a cavern and performing a phase separation of the hydrocarbon stream within the cavern to recover a number of separated streams, wherein the separated streams include a liquid hydrocarbon stream, a gas stream, a water stream, and a solids stream. The method also includes injecting an amount of the gas stream directly back into the hydrocarbon reservoir at a first time and injecting an amount of the water stream directly into an aquifer at a second time. The method further includes sending at least a portion of any of the separated streams to a new subsurface location through a subsurface line.

BRIEF DESCRIPTION OF THE DRAWINGS

The advantages of the present techniques are better understood by referring to the following detailed description and the attached drawings, in which.

DETAILED DESCRIPTION

Figure 1:
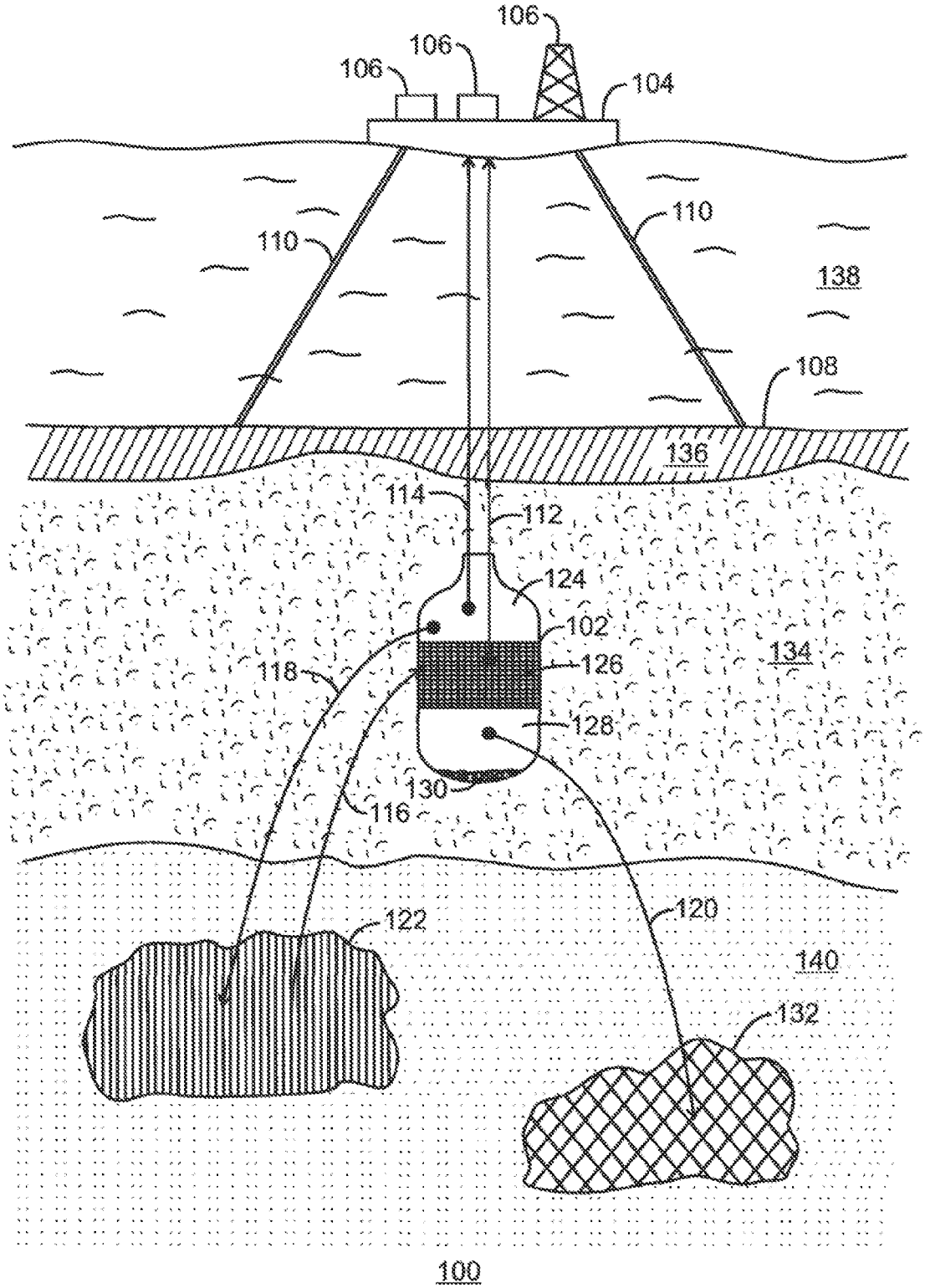
FIG. 1 is a system for processing, storing, and offloading liquid hydrocarbon, such as oil or condensate, and natural gas using an in-field salt cavern.

In the following detailed description section, specific embodiments of the present techniques are described. However, to the extent that the following description is specific to a particular embodiment or a particular use of the present techniques, this is intended to be for exemplary purposes only and simply provides a description of the exemplary embodiments. Accordingly, the techniques are not limited to the specific embodiments described below, but rather, include all alternatives, modifications, and equivalents falling within the true spirit and scope of the appended claims.

At the outset, for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

A "facility" as used herein is a representation of a tangible piece of physical equipment through which hydrocarbon fluids are either produced from a reservoir or injected into a reservoir. In its broadest sense, the term facility is applied to any equipment that may be present along the flow path between a reservoir and the destination for a hydrocarbon product. Facilities may include drilling platforms, production platforms, production wells, injection wells, well tubulars, wellhead equipment, gathering lines, manifolds, pumps, compressors, separators, surface flow lines, and delivery outlets. In some instances, the term "surface facility" is used to distinguish those facilities other than wells. A "facility network" is the complete collection of facilities that are present in the model, which would include all wells and the surface facilities between the wellheads and the delivery outlets.

The term "gas" is used interchangeably with "vapor," and means a substance or mixture of substances in the gaseous state as distinguished from the liquid or solid state. Likewise, the term "liquid" means a substance or mixture of substances in the liquid state as distinguished from the gas or solid state. As used herein, "fluid" is a generic term that may include gases, liquids, combinations of either, and supercritical fluids.

A "hydrocarbon" is an organic compound that primarily includes the elements hydrogen and carbon although nitrogen, sulfur, oxygen, metals, or any number of other elements may be present in small amounts. As used herein, hydrocarbons generally refer to organic materials that are transported by pipeline, such as any form of natural gas, condensate, crude oil, or combinations thereof. A "hydrocarbon stream" is a stream enriched in hydrocarbons by the removal of other materials, such as water. A hydrocarbon stream may also be referred to as an "organic phase."

"Liquefied natural gas" or "LNG" is natural gas that has been processed to remove impurities, such as, for example, nitrogen, and water or heavy hydrocarbons, and then condensed into a liquid at almost atmospheric pressure by cooling and depressurization.

As used herein, the term "natural gas," or simply "gas," refers to a multi-component gas obtained from a crude oil or gas condensate well (termed associated gas) or from a subterranean gas-bearing formation (termed non-associated gas). The composition and pressure of natural gas can vary significantly. A typical natural gas stream contains methane ($CH_4$) as a significant component. Raw natural gas will also typically contain ethane ($C_2H_6$), other hydrocarbons, one or more acid gases (such as carbon dioxide, hydrogen sulfide, carbonyl sulfide, carbon disulfide, and mercaptans), and minor amounts of contaminants such as water, nitrogen, iron sulfide, wax, and crude oil.

"Pressure" is the force exerted per unit area by the fluid on the walls of the volume. Pressure can be shown as pounds per square inch (psi). "Atmospheric pressure" refers to the local pressure of the air. "Absolute pressure" (psia) refers to the sum of the atmospheric pressure (14.7 psia at standard conditions) plus the gauge pressure (psig). "Gauge pressure" (psig) refers to the pressure measured by a gauge, which indicates only the pressure exceeding the local atmospheric pressure (i.e., a gauge pressure of 0 psig corresponds to an absolute pressure of 14.7 psia).

"Production fluid" refers to a liquid or gaseous stream removed from a subsurface formation, such as an organic-rich rock formation. Produced fluids may include both hydrocarbon fluids and non-hydrocarbon fluids. For example, production fluids may include, but are not limited to, oil, condensate, natural gas, and water.

"Substantial" when used in reference to a quantity or amount of a material, or a specific characteristic thereof, refers to an amount that is sufficient to provide an effect that the material or characteristic was intended to provide. The exact degree of deviation allowable may in some cases depend on the specific context.

"Well" or "wellbore" refers to a hole in the subsurface made by drilling or insertion of a conduit into the subsurface. The terms are interchangeable when referring to an opening in the formation. A well may have a substantially circular cross section, or other cross-sectional shapes, such as, for example, circles, ovals, squares, rectangles, triangles, slits, or other regular or irregular shapes. Wells may be cased, cased and cemented, or open-hole, and may be any type, including, but not limited to a producing well, an experimental well, and an exploratory well, or the like. A well may be vertical, horizontal, or any angle between vertical and horizontal (a deviated well), for example a vertical well may include a non-vertical component.

"Total storage capacity" refers to the maximum amount, or greatest volume, of oil, condensate, and natural gas that may be stored in an underground storage facility. "Total hydrocarbon in storage" refers to the actual amount of liquid hydrocarbon, such as oil or condensate, and natural gas that is in an underground storage facility at a specific point in time. The "base hydrocarbon," or "cushion hydrocarbon," is the minimum amount, or lowest volume, that may be in an underground storage facility at any point in time to maintain adequate pressure and deliverability rates within the facility. The "working hydrocarbon capacity" is the total storage capacity minus the cushion hydrocarbon, or the maximum amount of liquid hydrocarbon, such as oil or condensate, and natural gas that may be produced from the underground storage facility. The "working hydrocarbon" is the total hydrocarbon in storage minus the cushion hydrocarbon, or the total amount of hydrocarbon that is available to be produced from an underground storage facility at any point in time.

"Perforations" are openings, slits, apertures, or holes in a wall of a conduit, tubular, pipe or other flow pathway that allow flow into or out of the conduit, tubular, pipe or other flow pathway. Perforations may provide communication from a wellbore to a reservoir, and the perforations may be placed to penetrate through the casing and the cement sheath surrounding the casing to allow hydrocarbon flow into the wellbore and, if necessary, to allow treatment fluids to flow from the wellbore into the formation. The perforations may have any shape, for example, round, rectangular, slotted or the like. The term is not intended to limit the manner in which the holes are made, i.e., it does not require that they be made by perforating, or the arrangement of the holes. A perforated well may be used to inject or collect fluids from a reservoir, such as fractures in a hot dry rock layer.

"Stimulation" refers to any stimulation technique known in the art for increasing production of desirable fluids from a subterranean formation adjacent to a portion of a well bore. Such techniques include, but are not limited to, matrix acidizing, acid fracturing, hydraulic fracturing, perforating, and hydro jetting.

"Hydraulic fracturing," also referred to simply as "fracturing" or "fracking," refers to the structural degradation of a treatment interval, such as a subsurface shale formation, from applied thermal or mechanical stress. Such structural degradation generally enhances the permeability of the treatment interval to fluids and increases the accessibility of the hydrocarbon component to such fluids. Fracturing may also be performed by degrading rocks in treatment intervals by chemical means. Fracturing may be used to break down a geological formation and to create a fracture, i.e. the rock formation around a well bore, by pumping fluid at very high pressures, in order to increase production rates from a hydrocarbon reservoir.

"Acidizing" refers to the general process of introducing an acid downhole to perform a desired function, e.g., to acidize a portion of a subterranean formation or any damage contained therein. Acidizing usually enhances hydrocarbon production by dissolving rock in a formation to enlarge the passages through which the hydrocarbon stream may flow, thereby increasing the effective well radius.

As used herein, the term "completion" may refer to the process of preparing a well for production or injection by performing multiple tasks, such as setting packers, installing valves, cementing, hydraulic fracturing, acidizing, perforating, and the like. This set of procedures results in the establishment or improvement of the physical connection between a well and the reservoir rock, so that hydrocarbons and water can flow more easily between the reservoir and the well, and in mechanically stabilizing the well to physical stresses. For example, completion procedures may include preparing the bottom of the hole to the required specification, running the production tubing down the wellbore, and performing perforation and stimulation in order to prepare the well for production or injection. "Production tubing" is a type of tubing that is used in a wellbore to provide a means of travel for production fluids.

An "open-hole completion" refers to a method of completing a wellbore, wherein the casing does not extend substantially to the bottom of the wellbore. For an "open-hole well," the liner string is in direct fluid communication with the formation. A "cased-hole completion" refers to a method of completing a wellbore, wherein the casing extends substantially to the bottom of the wellbore. For a "cased-hole well," the liner string is not in direct fluid communication with the formation but, instead, is lined with cement, or "casing."

Bedded salt formations, i.e., "salt beds," typically include multiple layers of salt separated by layers of other rocks, such as shale, sandstones, dolomite, and anhydrite, and often contain impurities. Salt beds generally have depths ranging from around five hundred to six thousand feet below the surface and may be up to around three thousand feet thick. A salt bed may also be referred to as a "salt sheet layer."

"Salt domes" are large, fingerlike projections of nearly pure salt that have risen above the source salt sheet. Salt domes are slowly formed as salt becomes buried under heavy overlying rock formations. Oil, gas, and other minerals are often found around the edges of salt domes. The tops of salt domes may reach to the surface or may be thousands of feet below the surface. In addition, salt domes generally range in width from around one half to five miles.

A "subterranean formation" is an underground geologic structure, regardless of size, comprising an aggregation of subsurface sedimentary, metamorphic, or igneous matter, whether consolidated or unconsolidated, and other subsurface matter, whether in a solid, semi-solid, liquid, or gaseous state, related to the geological development of the subsurface region. A subterranean formation may contain numerous geologic strata of different ages, textures, and mineralogical compositions. A subterranean formation may include a subterranean, or subsurface, reservoir that includes oil or other gaseous or liquid hydrocarbons, water, or other fluids. A subterranean formation may include, but is not limited to geothermal reservoirs, petroleum reservoirs, sequestering reservoirs, and the like.

A "reservoir" is a subsurface rock formation from which a production fluid may be harvested or into which a byproduct may be injected. The rock formation may include granite, silica, carbonates, clays, and organic matter, such as oil, gas, or coal, among others. Reservoirs may vary in thickness from less than one foot to hundreds of feet. The permeability of the reservoir provides the potential for production. As used herein, a reservoir may also include a hot dry rock layer used for geothermal energy production. A reservoir may often be located at a depth of fifty meters or more below the surface of the earth or the seafloor.

A "wormhole" is a high-permeability channel in a formation generated as a result of a man-made process. More specifically, wormholes may be created by the process of dissolving carbonates with acid or by removing heavy oil, particulate solids, or other materials from the formation through a wellbore, thereby creating a lower pressure zone around the wellbore. Additional materials may then flow into this low pressure zone, leaving behind wormholes. Wormholes typically extend away from the low pressure region around the wellbore and may be open, roughly tubular routes or simply zones of higher porosity and permeability than the surrounding naturally-occurring formation.

Overview

Embodiments disclosed herein provide methods and systems that allow for the production, storage, and offloading of liquid hydrocarbon, such as oil or condensate, or natural gas, or any combination thereof, using underground caverns. The system described herein may be referred to as a "Subsurface Production Storage and Offloading" cavern, or SPSO unit. The SPSO unit of the current system may replace an FPSO (Floating Production Storage and Offloading) unit in order to reduce the high cost of above-surface processing, storage, and offloading equipment, as discussed above. Depending on the cost of operation for the SPSO unit, subsurface processing, storage, and offloading may lower the cost of operation, especially in offshore, deepwater, arctic, or remote locations. For example, the cost of operation may be reduced by decreasing the power requirements for reinjection and downhole pumping. Moreover, subsurface processing may reduce or eliminate the volume of separator and storage vessels and potentially surface footprint by allowing the creation of a facility that does not use a flare system and, in some cases, has almost no emissions.

The system and methods disclosed herein may involve the creation of large salt caverns with high total storage capacities, for example, on the order of one million to tens of millions of barrels. The use of such large salt caverns may provide long residence times for the separation and storage of hydrocarbons. Therefore, wells and reservoirs may be produced more slowly and steadily over the course of months or years, with ships or tankers only arriving periodically to collect the hydrocarbons. In addition, the potentially long residence times may make the development of facilities in small or isolated reservoirs economical, particularly in remote locations that experience severe weather during some seasons. Further, such systems may allow the development of resources in Arctic environments, in which the wells are covered by ice for substantial portions of each year.

FIG. 1 is a system 100 for processing, storing, and offloading liquid hydrocarbon, such as oil or condensate, and natural gas using an in-field salt cavern 102. In this embodiment, oil is the exemplary liquid hydrocarbon. The system 100 includes the salt cavern 102 coupled to a platform 104 or other temporary or permanent facility. Any number of different types of platforms, rigs, or other facilities may be used. In addition, the platform 104 can include auxiliary equipment 106, such as a tower or derrick, and storage vessels for offloaded hydrocarbons or water for salt cavern leaching. The platform 104 may be used to transport production fluids to shore facilities by pipeline (not shown) or may store fluids in tanks for offloading to other vessels. In addition, the platform 104 may be anchored to the sea floor 108 by a number of tethers 110 or may be a free-floating vessel. The salt cavern 102 may be coupled to the platform 104, for example, by production lines 112 and 114. Production lines 112 and 114 may be flexible to allow movement of the platform 104. An oil transfer line 112 may be used to carry oil to the platform 104, while a gas line 114 may be used to carry gas to the platform 104.

The salt cavern 102 may also be connected to a number of other lines, such as lines 116, 118, and 120. In some embodiments, the lines 116, 118, and 120 may be cased to prevent closure due to salt creep or uncontrolled growth if exposed to produced water. A well feed line 116 may be used to carry a hydrocarbon stream from a hydrocarbon-bearing formation 122 to the salt cavern 102. The salt cavern 102 may be utilized as a multi-phase separation vessel in order to separate the stream into gas 124, oil 126, water 128, and solids 130. Some amount of the separated gas 124 may be reinjected into the hydrocarbon-bearing formation 122 through a gas reinjection line 118. In addition, some amount of the separated water 128 may be reinjected into an aquifer 132 or any other proximate body of water through a water injection line 120.

In some embodiments, the salt cavern 102 may be created within a salt sheet layer 134. In other embodiments, the salt cavern 102 may be created in a salt dome (not shown). The salt sheet layer 134 or salt dome may be located beneath an overburden rock layer 136, which may be located beneath an ocean 138 or other body of water. However, the techniques are not limited to subsea operations and may be used for surface fields, for example, in remote areas. The hydrocarbon reservoir 122 and aquifer 132 may be located in one or more subterranean formations 140 located beneath, beside, or above the salt sheet layer 134 or salt dome. Further, the aquifer 132 may be fluidically coupled to the hydrocarbon reservoir 122, such that any water injected into the aquifer maintains or increases the pressure of the hydrocarbon reservoir.

The salt cavern 102 may be formed by a number of different methods. In general, the salt caverns may be formed by a process called solution mining or salt cavern leaching. Well-drilling equipment may be used to drill a hole from the surface to the depth of the salt sheet layer 134. The portion of the well above the salt sheet layer 134 may be supported by several concentric layers of pipe known as casing. The casing is often cemented in place and is used to prevent the collapse of the hole. A smaller-diameter pipe called tubing may be lowered through the middle of the casing string, creating a pathway through which fluids may enter or exit the well.

In order to form the salt cavern 102, water leaching of the well may be performed by pumping unsaturated water, i.e., fresh water, brackish water, or ocean water, through the well. As the unsaturated water contacts the salt sheet layer 134, the salt may dissolve until the water becomes saturated with salt. The salty brine may then be pumped to the surface or other subsurface location, e.g., the aquifer 132, creating a cavern space. The desired size and shape of the salt cavern 102 may then be achieved by alternating between the withdrawal of brine from the salt cavern 102 and the injection of additional unsaturated water into the salt cavern 102. The desired size and shape of the salt cavern 102 may be determined based on the intended use of the salt cavern 102 and the nature of the salt sheet layer 134 or other salt formation in which it is formed. Once the salt cavern 102 has been formed, the walls of the salt cavern 102 are very strong due to the extreme geologic pressures. Any cracks that may occur on the cavern walls are almost immediately sealed due to the "self-healing" nature of the salt cavern 102.

It should be understood that the aforementioned process for forming the salt cavern 102 is only meant as an example of one of many different techniques for creating in-field salt caverns. In some embodiments, other excavation technologies may also be used to form the salt cavern 102. Examples of these excavation technologies include micro-tunneling, underreaming, boring, hydro-excavation, or the use of mechanical systems, or any combinations thereof, coupled with rock stabilization when necessary. Further, in other embodiments, a single salt cavern may be designed to service multiple separate hydrocarbon reservoirs through using extended-reach directional drilling techniques. This may allow for the economic development of many small, stranded oil and gas deposits. In yet another embodiment, the salt cavern 102 may be created by using unsaturated water to create wormholes within a salt formation and, thus, enlarge the size of the salt cavern 102. The unsaturated water may be injected at specific flow rates in order to ensure the proper formation of the salt cavern 102.

The salt cavern 102 may be formed in any of a variety of different shapes. The shape of the salt cavern 102 may be determined based on many different factors, such as efficiency and capacity requirements. In addition, whether the underground salt formation 134 is a salt dome or a salt bed may also play a role in determining the shape of the salt cavern 102. Possible salt cavern shapes include cylindrical shapes, conical shapes, or irregular shapes.

In-Field Salt Cavern

Figure 2:
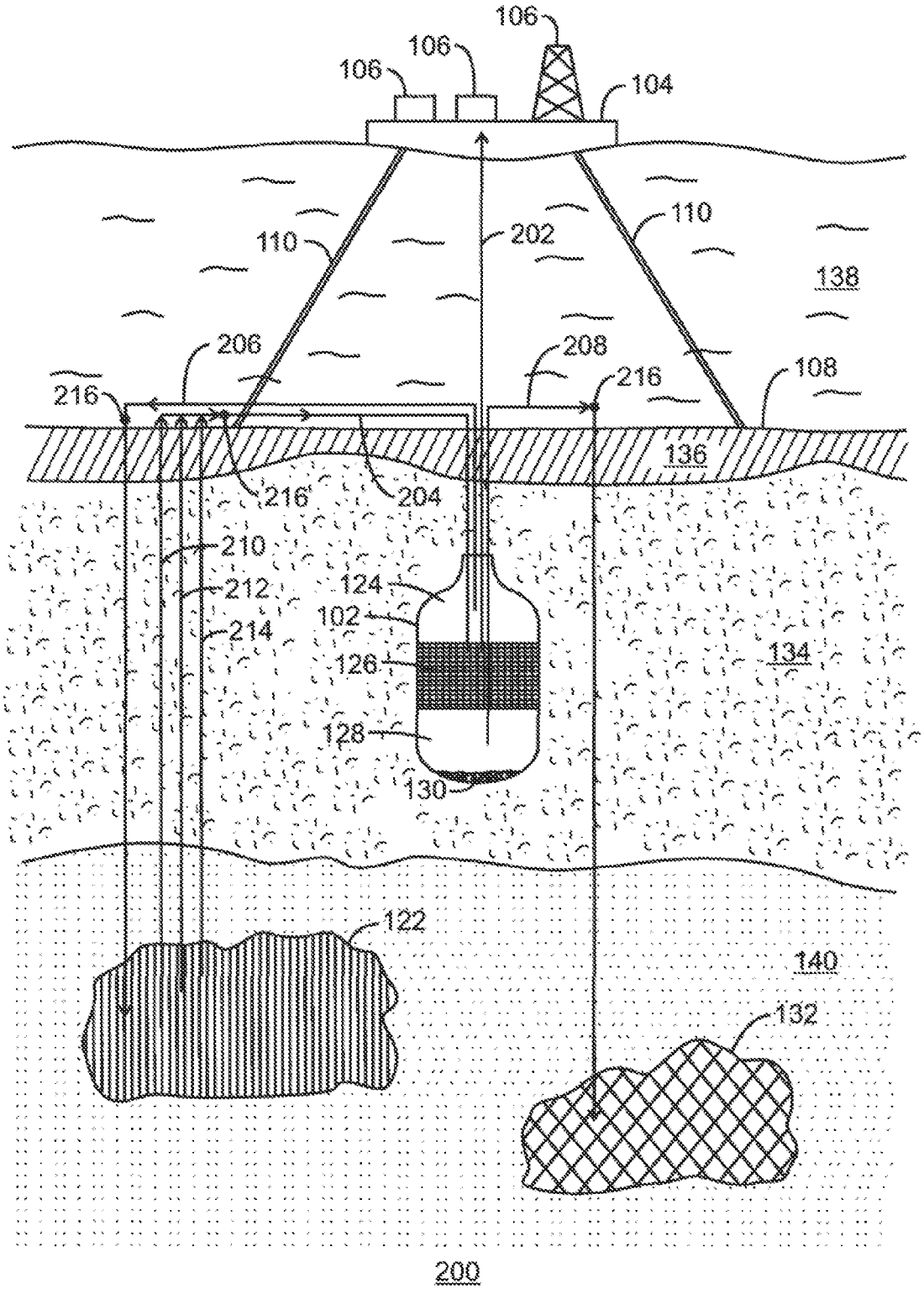
FIG. 2 is a system for processing, storing, and offloading liquid hydrocarbon, such as oil or condensate, and natural gas using an in-field salt cavern connected to multiple well feeds.

FIG. 2 is a system 200 for processing, storing, and offloading liquid hydrocarbon, such as oil or condensate, and natural gas using an in-field salt cavern 102 connected to multiple well feeds. For example, in embodiments disclosed herein, oil is utilized as the liquid hydrocarbon. The system 200 may include the salt cavern 102 coupled to a platform 104 or other facility. Like numbered items are as described with respect to FIG. 1. The salt cavern 102 may be connected to the platform 104 by production line 202. The production line 202 may be flexible to allow movement of the platform 104. In addition, the production line 202 may be used to carry gas and oil to the platform 104, for example, within multiple tubes in the production line 202. Any number of additional lines (not shown) may be added to the system 200 and may be used to transport production fluids, such as oil and gas, to the platform 104.

The salt cavern 102 may also be connected to a number of other lines, such as lines 204, 206, and 208. A production fluid line 204 may be used to carry a hydrocarbon stream from the hydrocarbon reservoir 122 to the salt cavern 102. For example, well feed lines 210, 212, and 214 may be coupled to the production fluid line 204 in order to allow for the injection of the hydrocarbon stream from the hydrocarbon reservoir 122 into the salt cavern 102. The production fluid line 204 may use auxiliary equipment 216 to aid in the movement of the hydrocarbon stream though the line 204. The auxiliary equipment 216 may include pumps, compressors, and valves, depending on the characteristics of the hydrocarbon stream and the pressure differential between the hydrocarbon reservoir 122 and the salt cavern 102.

The salt cavern 102 may be utilized as a multi-phase separation vessel in order to separate the stream into gas 124, oil 126, water 128, and solids 130, as discussed with respect to FIG. 1. Some amount of the separated gas 124 may be reinjected into the hydrocarbon reservoir 122 through the gas line 206. In addition, some amount of the separated water 128 may be injected into the aquifer 132 or any other proximate body of water through the water injection line 208. The lines 206 and 208 may also include auxiliary equipment 216 to assist in the movement of the fluids, as discussed above.

Two In-Field Salt Caverns

Figure 3:
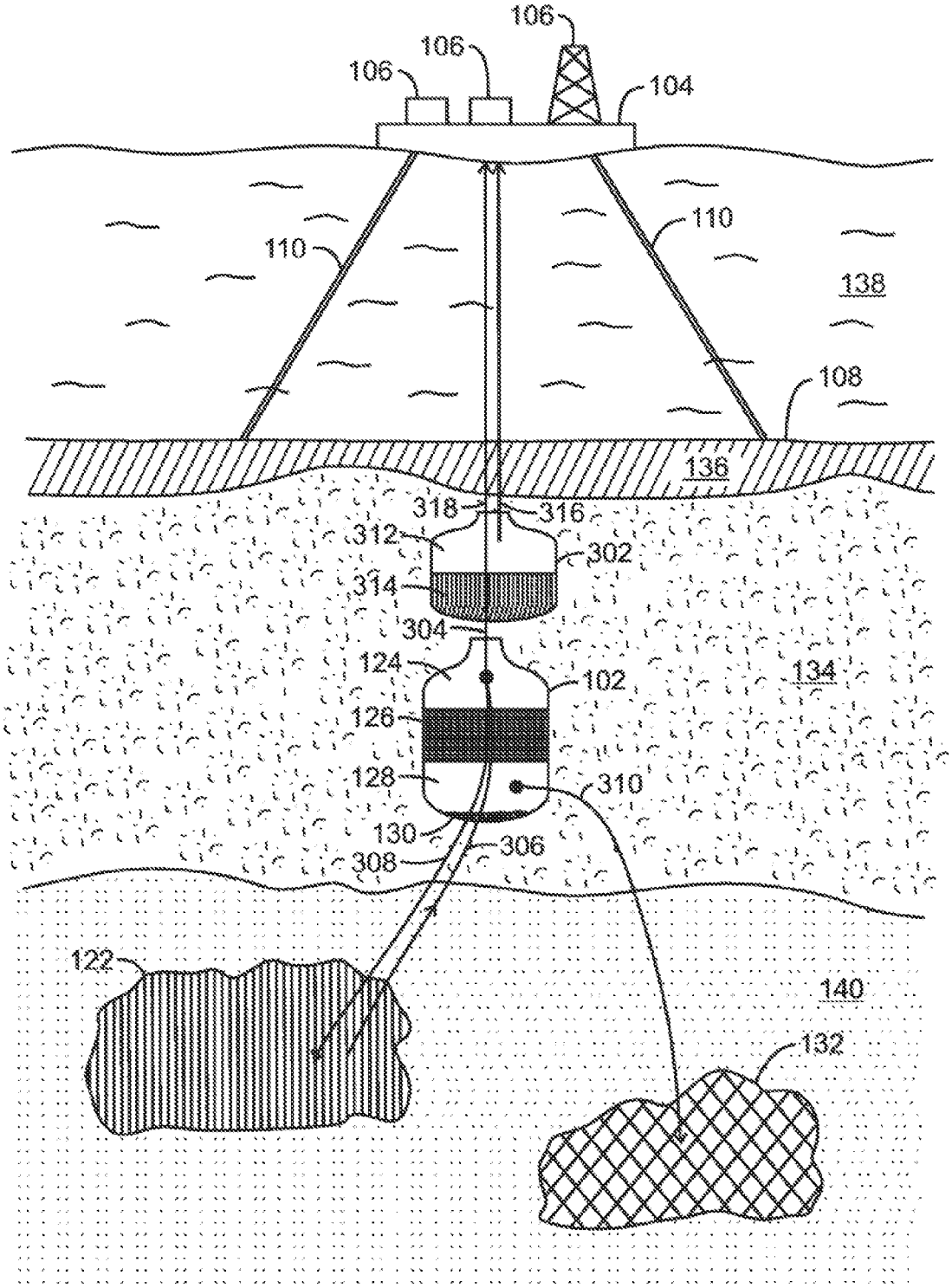
FIG. 3 is a system for processing, storing, and offloading liquid hydrocarbon, such as oil or condensate, and natural gas using two in-field salt caverns.

FIG. 3 is a system 300 for processing, storing, and offloading liquid hydrocarbon, such as oil or condensate, and natural gas using two in-field salt caverns 102 and 302. Like numbered items are as described with respect to FIG. 1. For example, in embodiments disclosed herein, oil is utilized as the liquid hydrocarbon. The salt caverns 102 and 302 may be coupled to each other using production line 304. The production line 304 may also be used to carry a hydrocarbon stream from the first salt cavern 102 to the second salt cavern 302 after an initial separation process is completed within the first salt cavern 102.

A hydrocarbon stream may be carried from the hydrocarbon reservoir 122 to the salt cavern 102 through well feed line 306. In the first salt cavern 102, a multi-phase separation may separate the hydrocarbon stream into gas 124, oil 126, water 128, and solids 130, or any combinations thereof, as discussed with respect to FIG. 1. Some of the gas 124 may then be reinjected into the hydrocarbon reservoir 122 through gas reinjection line 308. In addition, some of the water 128 may be injected into the aquifer 132 or other proximate body of water through water injection line 310.

In the second salt cavern 302, the hydrocarbon stream may be further separated into gas 312 and oil 314. The gas 312 may be sent to a platform 104 or other facility through a gas production line 316, while the oil 314 may be sent to the platform 104 through an oil production line 318 for storage or production. The production lines 316 and 318 may also be used to couple both of the salt caverns 102 and 302 to the platform 104. The production lines 316 and 318 may be flexible to allow movement of the platform 104.

Three In-Field Salt Caverns

Figure 4:
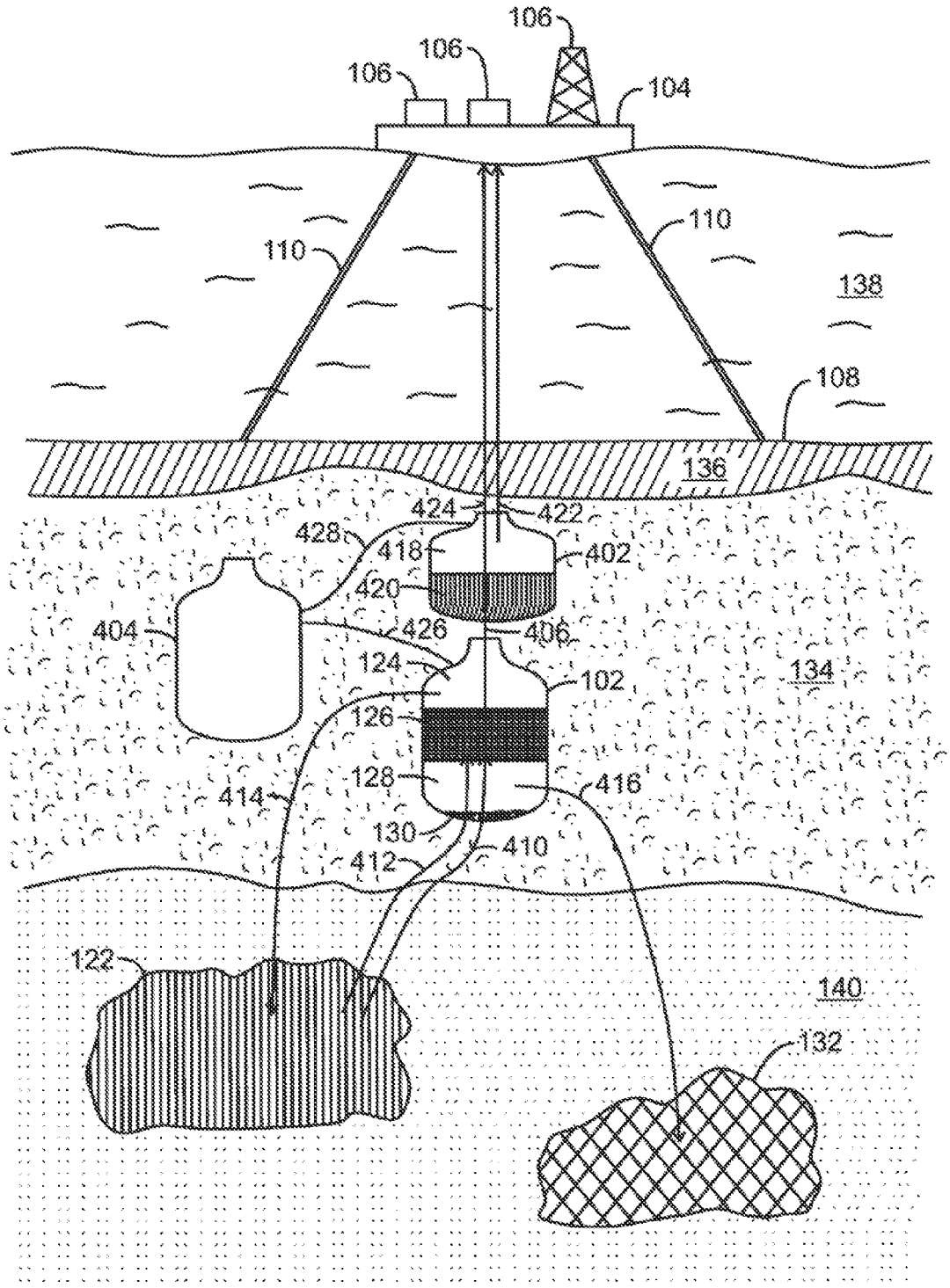
FIG. 4 is a system for processing, storing, and offloading liquid hydrocarbon, such as oil or condensate, and natural gas using three in-field salt caverns.

FIG. 4 is a system 400 for processing, storing, and offloading liquid hydrocarbon, such as oil or condensate, and natural gas using three in-field salt caverns 102, 402, and 404. Like numbered items are as described with respect to FIG. 1. For example, in embodiments disclosed herein, oil is utilized as the liquid hydrocarbon. The first two salt caverns 102 and 402 may be coupled to each other using a production line 406. Thus, the production line 406 may be used to carry a hydrocarbon stream from the first salt cavern 102 to the second salt cavern 402 after an initial separation process is completed within the first salt cavern 102.

A hydrocarbon stream may be carried from a hydrocarbon reservoir 410 to the first salt cavern 102 through production lines 410 and 412. Within the salt cavern 102, a multi-phase separation process may be used to separate the hydrocarbon stream into gas 124, oil 126, water 128, and solids 130, or any combinations thereof, as described with respect to FIGS. 1, 2, and 3. Some of the gas 124 may then be reinjected into the hydrocarbon reservoir 122 through gas reinjection line 414. In addition, some of the water 128 may be injected into the aquifer 132 or other proximate body of water through a water injection line 416.

The separated hydrocarbon stream may be carried from the first salt cavern 102 to the second salt cavern 402 through the production line 406, as discussed above. In the second salt cavern 402, the hydrocarbon stream may be further separated into gas 418 and oil 420. The gas 418 may be sent to the platform 104 or other facility through production line 422, while the oil 420 may be sent to the platform 104 through production line 424 for storage or production. The production lines 422 and 424 may also be used to couple the salt caverns 102 and 402 to the platform 104. The production lines 422 and 424 may be flexible to allow movement of the platform 104.

The third salt cavern 404 may be used as a gas storage vessel. The third salt cavern 404 may be coupled to the first salt cavern 102 by a gas line 426. In addition, the third salt cavern 404 may also be coupled to the second salt cavern 402 by a gas line 428. The gas 124 from the first salt cavern 102 and the gas 418 from the second salt cavern 402 may be injected into the third salt cavern 404 in order to maintain appropriate pressures within the first two salt caverns 102 and 402. The gas may then be stored within the third salt cavern 404 for extended periods of time or until it is desired for pressurization, production, or reinjection purposes.

In various embodiments, the systems 100, 200, 300, and 400, i.e., the SPSO systems or units, may include any number of additional salt caverns. The additional salt caverns may be used for the separation of hydrocarbon streams or for the storage of previously-separated hydrocarbon streams. In addition, in an embodiment, any number of salt caverns may be connected in series and utilized as multi-phase separation vessels in order to achieve the desired degree of separation. In another embodiment, a salt cavern may function as a multi-phase separation vessel and may be connected to any number of additional salt caverns, wherein the additional salt cavern may store the hydrocarbon streams for extended periods of time or until the hydrocarbon is desired for production purposes.

The SPSO systems may include active controls for the monitoring of the pressure and fluid levels within the salt caverns. Any number of different types of pressure or level detectors or sensors may be used for this purpose. For example, a nucleonic level detector may be used as a level detector within a salt cavern. These systems involve a source that emits a narrow fan of radiation through the fluid and toward a detector. The detector may then measure the electromagnetic energy from the source as the fluid level rises within the vessel. The detector may accurately determine the level of the fluid according to the amount of electromagnetic energy detected, since the fluid may progressively shield the radiation from reaching the detector. In some embodiments, the detector and sources may be attached to tubing or casing strings, or annular spacings therein, to effect measurement of levels between the detector and source.

In some embodiments, a differential pressure (DP) cell level transmitter may be used to measure the fluid level with the salt cavern. A DP cell level transmitter measures the level of the fluid in a vessel by determining the head pressure of the fluid in the vessel using a detector mounted to the bottom of the vessel. In some embodiments, an optical level detector may measure the fluid level within the salt cavern through the detection of reflected light within the cavern as the fluid level rises. Moreover, in some embodiments, a refractive index level detector may also be used to measure the fluid level within the salt cavern. The refractive index level detector, similarly to the optical level detector, may measure the fluid level within the salt cavern by detecting the refraction or loss of a light beam within a detector as the fluid level rises over the detector.

In some embodiments, the pressure level within the salt cavern may be monitored using a diaphragm-based strain gauge. The diaphragm-based strain gauge may detect the pressure within the salt cavern by measuring the deformity of a diaphragm as the pressure within the salt cavern exerts a strain on the diaphragm. Any other types of pressure detectors or sensors, such as, for example, differential pressure sensors, may be used. The active controls for pressure and fluid level may also include pumps, check valves, or any other types of valves, or any combinations thereof, in order to allow for the effective control of the pressure and fluid level within the salt cavern.

Power may be supplied to the SPSO systems from a number of sources. Power may be supplied continuously by a topside source, for example, or may be supplied episodically by a ship, tanker, or other vessel in offshore applications. Further, power may be generated using turbines by taking advantage of the pressure differentials between different subsurface formations. In other embodiments, a nuclear power source may be used to generate power for an SPSO system. In addition, a power source may not be needed for certain parts of an SPSO system. For example, the pressure differential between an aquifer and a salt cavern may be such that a power source is not needed in order to drive the injection of water from the salt cavern to the aquifer. In some applications, the pressure within the salt cavern may be maintained at a relatively high level in order to reduce the power requirements for produced water or gas injection into nearby depleted aquifers, hydrocarbon reservoirs, or other subterranean formations. In some embodiments, the first salt cavern in the SPSO system 300 or 400 may be maintained at the highest pressure, while the last salt cavern may be maintained at the lowest pressure in order to drive the movement of the hydrocarbon stream through the SPSO system 300 or 400 and aid in liquid hydrocarbon stabilization. The conditions of each SPSO system may vary according to the location of the particular system and the relative depths and pressures of the various formations. Therefore, the parameters of each SPSO system may be adjusted to account for the specific conditions and restraints of the system.

The walls of the salt caverns in the SPSO system may be coated to slow the dissolution rate of the salt caverns and, thus, provide for a higher degree of stability within the salt caverns. Such coatings may include polymers and less soluble salts.

The salt caverns may maintain at least a certain fluid level at all times in order to ensure that the salt cavern remains within a specific pressure range. This may be referred to as the base hydrocarbon, or cushion hydrocarbon, level for the salt cavern. Maintaining at least the base hydrocarbon level within the salt cavern helps to prevent the salt cavern from collapsing and also maintains deliverability rates at a desirable level.

The solids separated from the hydrocarbon stream within the salt cavern may provide additional stability for the salt cavern by acting as a protective barrier along the bottom of the salt cavern. The solids may act as a retardant against further downward dissolution due to a reduction in the potential amount of unsaturated water that can contact the salt at the bottom of the cavern.

In some embodiments, the platform that is coupled to the salt cavern in the SPSO system may also be other types of transportation systems, such as ships or tankers. The transportation system may transport hydrocarbons through a pipeline to some onshore or offshore location for production or storage. In some applications, the platform or transportation system may be disconnected from the salt cavern and moved to another location. In this case, the salt cavern may function independently until another transportation system arrives to continue hydrocarbon removal. This type of intermittent collection may be particularly useful in extreme environments, such as in the Arctic, where ice and other weather conditions may prevent hydrocarbon production during the winter season.

While the systems disclosed herein are described with respect to the use of a salt cavern, it should be understood that any other type of subsurface cavern may also be used in conjunction with the current systems. For example, carbonate caverns may be used in conjunction with the current systems. Carbonates are a class of sedimentary rocks composed primarily of one or more categories of carbonate minerals, including limestone and dolomite. While a salt cavern may be created through water leaching, as discussed above, a carbonate cavern may be created through acid leaching. Carbonate caverns may be preferable in some applications due to their high structural stability. Due to the characteristics of carbonate, carbonate caverns may be less prone to subsequent acid or water leaching after the cavern has been created. Further, any other suitable types of rock formations may be dissolved with high temperature water, acid, or caustic to create subsurface caverns.

Method for Liquid Hydrocarbon Production Using Salt Cavern

Figure 5:
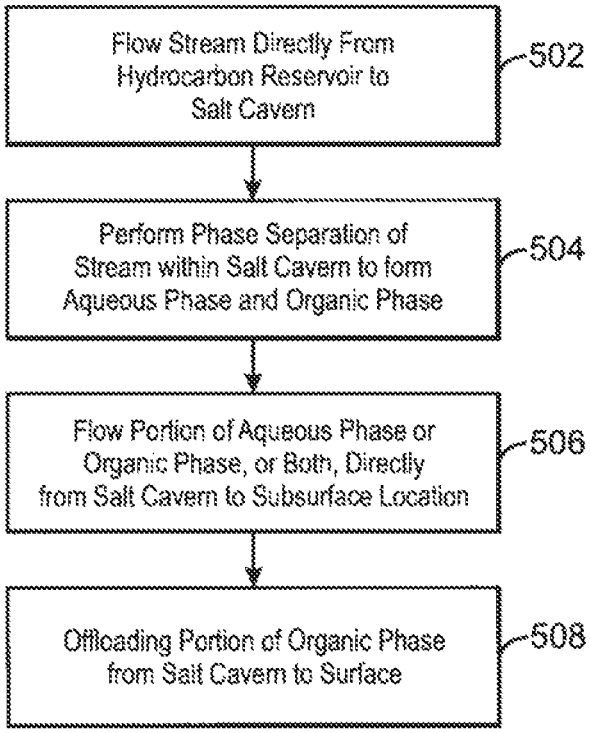
FIG. 5 is a process flow diagram showing a method for the processing, storage, and offloading of liquid hydrocarbon, such as oil or condensate, and natural gas using a salt cavern.

FIG. 5 is a process flow diagram showing a method 500 for the processing, storage, and offloading of liquid hydrocarbon, such as oil or condensate, and natural gas using a salt cavern. For example, in embodiments disclosed herein, oil is utilized as the liquid hydrocarbon. The method begins at block 502 with the flowing of a stream directly from a hydrocarbon reservoir to a salt cavern. In some embodiments, the stream may be flowed directly from the hydrocarbon reservoir to the salt cavern without reaching the surface. For example, the stream may flow from a hydrocarbon reservoir located in a subterranean formation to a salt cavern located in a salt formation without ever coming into contact with an overburden rock layer located above the salt formation.

At block 504, phase separation may be performed within the salt cavern to form an aqueous phase and an organic phase. The aqueous phase may include water with some degree of particulate matter, such as sand and other solids, dissolved in the water. The organic phase may include gas or oil, or any combination thereof. Further, in some embodiments, the organic phase includes more than one organic phase, such as a liquid hydrocarbon phase and a natural gas phase. The phase separation may include a multi-phase separation process in which the less dense organic phase is allowed to float to the top of the salt cavern, while the denser aqueous phase sinks to the bottom of the salt cavern. The pressure, temperature, and fluid level parameters within the salt cavern may be controlled using the aforementioned sensors or detectors in order to allow for the effective separation of the aqueous phase from the organic phase.

At block 506, at least a portion of the aqueous phase or the organic phase, or both, may be flowed from the salt cavern to another subsurface location. In some embodiments, the aqueous phase may be flowed from the salt cavern to an aquifer, a body of water, a sand formation, or a subterranean formation, or any combinations thereof, while the organic phase may be flowed from the salt cavern to the hydrocarbon reservoir, a sand formation, or a subterranean formation, or any combinations thereof. For example, a portion of the aqueous phase may be injected into an aquifer in order to dispose of excess water within the salt cavern, while a portion of the organic phase may be reinjected back into the hydrocarbon reservoir in order to dispose of excess natural gas within the salt cavern without causing a surface footprint or any other environmental ramifications.

At block 508, at least a portion of the organic phase may be offloaded from the salt cavern to the surface. Specifically, a portion of the organic phase may be offloaded to a transportation system, wherein the transportation system may include a pipeline, a tanker, a ship, or a platform, or any combinations thereof. In some embodiments, the salt cavern may be disconnected from the transportation system at the surface for certain periods of time. A buoy-marked connection may be used to indicate the location of the salt cavern during the periods of time when the transportation system is disconnected from the salt cavern. In such cases, the size of the salt cavern may be large enough to allow for long residence times for hydrocarbon storage within the salt cavern. Further, a transportation system may be reconnected to the salt cavern at any point in time for an aperiodic collection of the hydrocarbons from the salt cavern.

The flow of the stream, or of the separated aqueous and organic phases, at blocks 502, 506, and 508 may be aided by any number of different power sources, such as a continuous power source supplied by a topside source, an episodic power source supplied by a ship or a tanker, a power source supplied by a differential pressure between subsurface locations, or any combinations thereof. In addition, downhole or in-cavern machinery may also be used to aid the flow of the stream, or of the separated aqueous and organic phases. The downhole or in-cavern machinery may include, for example, compressors or pumps, or any combination thereof.

It should be noted that the process flow diagram is not intended to indicate that the steps of method 500 must be executed in any particular order or that every step must be included for every case. Further, additional steps may be included which are not shown in FIG. 5. For example, in some embodiments, the methods at blocks 506 and 508 may be removed entirely. Further, in other embodiments, any number of additional salt caverns may be coupled to the initial salt cavern and may be used to store the organic phase or to further process the organic phase by performing any number of additional phase separation processes. For example, multiple connected salt caverns may be used to affect a multi-stage phase separation of a stream, while any number of additional connected caverns may be used to store the organic phase, the aqueous phase, or any combination thereof, for varying periods of time. Further, salt caverns may be disconnected from each other using a cold-finger device to reseal the interconnection between the salt caverns by redepositing salts within the interconnection. Therefore, the method 500 may include a varying number of connected salt caverns, depending on the specific application. A salt cavern may be configured to accept a number of streams from a number of different hydrocarbon reservoirs, or the salt cavern may be configured to flow portions of the organic phase or the aqueous phase, or both, to multiple different subsurface locations simultaneously.

EMBODIMENTS

Embodiments of the invention may include any combinations of the methods and systems shown in the following numbered paragraphs. This is not to be considered a complete listing of all possible embodiments, as any number of variations can be envisioned from the description above.

1. A method for production of hydrocarbons, including:
   - flowing a stream directly from a hydrocarbon reservoir to a cavern;
   - performing a phase separation of the stream within the cavern to form an aqueous phase and an organic phase;
   - flowing at least a portion of the aqueous phase or the organic phase, or both, directly from the cavern to a subsurface location; and
   - offloading at least a portion of the organic phase from the cavern to a surface.

2. The method of paragraph 1, wherein performing the phase separation of the stream within the cavern includes separating the stream into liquid hydrocarbon, water, gas, or solids, or any combinations thereof.

3. The method of paragraph 1 or 2, including storing at least a portion of the aqueous phase or the organic phase, or both, within the cavern.

4. The method of any of paragraphs 1, 2, or 3, wherein flowing at least a portion of the aqueous phase or the organic phase, or both, directly from the cavern to the subsurface location includes flowing at least a portion of the aqueous phase into an aquifer, a body of water, a sand formation, or a subterranean formation, or any combinations thereof.

5. The method of any of the preceding paragraphs, wherein flowing at least a portion of the aqueous phase or the organic phase, or both, directly from the cavern to the subsurface location includes flowing at least a portion of the organic phase into the hydrocarbon reservoir, a sand formation, or a subterranean formation, or any combinations thereof.

6. The method of any of the preceding paragraphs, wherein offloading at least a portion of the organic phase from the cavern to the surface includes sending at least a portion of the organic phase to a transportation system, wherein the transportation system includes a tanker, a platform, a ship, a pipeline, or any combinations thereof.

7. The method of any of the preceding paragraphs, including flowing at least a portion of the aqueous phase or the organic phase, or both, directly from the cavern to a second cavern, wherein the second cavern includes a storage vessel or a multi-stage separation vessel, or both.

8. The method of any of the preceding paragraphs, including flowing at least a portion of the aqueous phase or the organic phase, or both, directly from the cavern to each of a number of new subsurface locations.

9. A system for production of hydrocarbons, including:
   - a cavern configured to affect a phase separation;
   - a hydrocarbon reservoir linked to the cavern directly through a subsurface;
   - a reinjection system configured to reinject a gas stream into the hydrocarbon reservoir from the cavern directly through the subsurface;
   - an injection system configured to inject an aqueous stream from the cavern into an aquifer directly through the subsurface; and
   - a coupling configured to allow offloading of at least a portion of an organic phase from the cavern to a transportation system.

10. The system of paragraph 9, wherein the aquifer is fluidically coupled to the hydrocarbon reservoir.

11. The system of paragraph 9 or 10, wherein the cavern includes a salt cavern, a carbonate cavern, or any other water-soluble or acid-soluble cavern.

12. The system of any of paragraph 9, 10, or 11, wherein the cavern includes an underground phase separator for separating gas, liquid hydrocarbon, water, or solids, or any combinations thereof.

13. The system of any of paragraphs 9-12, wherein the cavern includes any of a number of shapes, including a cylindrical shape, a conical shape, or an irregular shape.

14. The system of any of paragraphs 9-13, wherein the cavern includes active controls for pressure and fluid level.

15. The system of paragraph 14, wherein the active controls for pressure and fluid level include a nucleonic level detector, a differential pressure (DP) cell level transmitter, an optical level detector, a refractive index level detector, or a diaphragm-based strain gauge, or any combinations thereof.

16. The system of paragraph 14, wherein the active controls for pressure and fluid level include pumps, valves, and check valves, or any combinations thereof.

17. The system of any of paragraphs 9-14, wherein the system is configured to reduce a power requirement for the cavern by increasing or decreasing a pressure level within the cavern.

18. The system of any of paragraphs 9-14 or 17, wherein the system includes multiple connected caverns, and wherein each cavern includes a phase separation vessel or a storage vessel, or both.

19. The system of any of paragraphs 9-14, 17, or 18, wherein the system includes:

a first cavern configured to create a first separated stream; and a second cavern fluidically coupled to the first cavern, wherein the second cavern accepts the first separated stream and creates a second separated stream.

20. The system of any of paragraphs 9-14 or 17-19, wherein the transportation system includes a pipeline, a platform, a tanker, or a ship, or any combinations thereof.

21. The system of any of paragraphs 9-14 or 17-20, wherein the cavern is configured to store a cushion hydrocarbon within the cavern, wherein the cushion hydrocarbon is a base hydrocarbon volume level for the cavern.

22. The system of any of paragraphs 9-14 or 17-21, wherein the cavern is configured to accept a number of streams directly from a number of hydrocarbon reservoirs.

23. The system of any of paragraphs 9-14 or 17-22, including downhole or in-cavern machinery for compression or reinjection of a stream, wherein the downhole or in-cavern machinery includes compressors or pumps, or any combination thereof.

24. The system of any of paragraphs 9-14 or 17-23, wherein the system includes a continuous power source supplied by a topside source, an episodic power source supplied by a ship or a tanker, a power source supplied by a differential pressure between subsurface locations, or any combinations thereof.

25. A method for harvesting hydrocarbons, including:

flowing a hydrocarbon stream from a hydrocarbon reservoir directly to a cavern;

performing a phase separation of the hydrocarbon stream within the cavern to recover a number of separated streams, wherein the number of separated streams include a liquid hydrocarbon stream, a gas stream, a water stream, and a solids stream; and injecting an amount of the gas stream directly back into the hydrocarbon reservoir at a first time;

injecting an amount of the water stream directly into an aquifer at a second time; and sending at least a portion of any of the number of separated streams to a new subsurface location through a subsurface line.

26. The method of paragraph 25, wherein the aquifer is fluidically coupled to the hydrocarbon reservoir.

27. The method of paragraph 25 or 26, including sending at least a portion of the liquid hydrocarbon stream or the gas stream, or both, to a location above surface, wherein the location above surface includes a transportation system.

28. The method of any of paragraphs 25, 26, or 27, wherein sending at least a portion of any of the number of separated streams to the new subsurface location includes sending at least a portion of the water stream or the gas stream, or both, to another cavern for further separation or storage, or any combination thereof.

29. The method of any of paragraphs 25-28, wherein the liquid hydrocarbon stream includes oil or condensate.

What is claimed is:

1. A method for production of hydrocarbons, comprising:

forming a cavern using solution mining;

flowing a stream directly from a hydrocarbon reservoir to the cavern without reaching a surface;

performing phase separation of the stream within the cavern to form an aqueous phase and an organic phase;

flowing at least a portion of the organic phase directly from the cavern to a separate subsurface location without reaching the surface; and offloading at least a portion of the organic phase from the cavern to the surface.

2. The method of claim 1, wherein performing the phase separation of the stream within the cavern comprises separating the stream into liquid hydrocarbon, water, gas, or solids, or any combinations thereof.

3. The method of claim 1, comprising storing at least a portion of the aqueous phase or the organic phase, or both, within the cavern.

4. The method of claim 1, further comprising flowing at least a portion of the aqueous phase into an aquifer, a body of water, a sand formation, or a subterranean formation, or any combinations thereof.

5. The method of claim 1, wherein flowing at least a portion of the organic phase directly from the cavern to the subsurface location comprises flowing at least a portion of the organic phase into a sand formation, or a subterranean formation, or any combinations thereof.

6. The method of claim 1, wherein offloading at least a portion of the organic phase from the cavern to the surface comprises sending at least a portion of the organic phase to a transportation system, wherein the transportation system comprises a tanker, a platform, a ship, a pipeline, or any combinations thereof.

7. The method of claim 1, comprising flowing at least a portion of the aqueous phase or the organic phase, or both, directly from the cavern to a second cavern without reaching the surface, wherein the second cavern comprises a storage vessel or a multi-stage separation vessel, or both.

8. The method of claim 1, comprising flowing at least a portion of the aqueous phase or the organic phase, or both, directly from the cavern to each of a plurality of new subsurface locations without reaching the surface.

9. The method of claim 1, wherein the cavern has a capacity of at least one million barrels.

10. The method of claim 1, wherein the cavern is a salt cavern.

11. The method of claim 1, wherein the cavern is one of conical or irregular in shape.

12. A system for production of hydrocarbons, comprising:

a cavern formed by solution mining and configured to affect a phase separation;

a hydrocarbon reservoir linked to the cavern directly through a subsurface without reaching a surface;

a reinjection system configured to reinject a gas stream into the hydrocarbon reservoir from the cavern directly through the subsurface without reaching the surface;

an injection system configured to inject an aqueous stream from the cavern into an aquifer directly through the subsurface; and a coupling configured to allow offloading of at least a portion of an organic phase from the cavern to a transportation system.

13. The system of claim 12, wherein the aquifer is fluidically coupled to the hydrocarbon reservoir.

14. The system of claim 12, wherein the cavern includes a salt cavern, a carbonate cavern, or any other water-soluble or acid-soluble cavern.

15. The system of claim 12, wherein the cavern comprises an underground phase separator for separating gas, liquid hydrocarbon, water, or solids, or any combinations thereof.

16. The system of claim 12, wherein the cavern comprises any of a plurality of shapes, comprising a cylindrical shape, a conical shape, or an irregular shape.

17. The system of claim 12, wherein the cavern comprises active controls for pressure and fluid level.

18. The system of claim 17, wherein the active controls for pressure and fluid level comprise a nucleonic level detector, a differential pressure (DP) cell level transmitter, an optical level detector, a refractive index level detector, or a diaphragm-based strain gauge, or any combinations thereof.

19. The system of claim 17, wherein the active controls for pressure and fluid level comprise pumps, valves, and check valves, or any combinations thereof.

20. The system of claim 12, wherein the system is configured to reduce a power requirement for the cavern by increasing or decreasing a pressure level within the cavern.

21. The system of claim 12, wherein the system comprises multiple caverns connected to each other without reaching the surface, and wherein each cavern comprises a phase separation vessel or a storage vessel, or both.

22. The system of claim 12, wherein the system comprises:

a first cavern configured to create a first separated stream; and a second cavern fluidically coupled to the first cavern without reaching the surface, wherein the second cavern accepts the first separated stream and creates a second separated stream.

23. The system of claim 12, wherein the transportation system comprises a pipeline, a platform, a tanker, or a ship, or any combinations thereof.

24. The system of claim 12, wherein the cavern is configured to store a cushion hydrocarbon within the cavern, wherein the cushion hydrocarbon is a base hydrocarbon volume level for the cavern.

25. The system of claim 12, wherein the cavern is configured to accept a plurality of streams directly from a plurality of hydrocarbon reservoirs without reaching the surface.

26. The system of claim 12, comprising downhole or in-cavern machinery for compression or reinjection of a stream, wherein the downhole or in-cavern machinery comprises compressors or pumps, or any combination thereof.

27. The system of claim 12, wherein the system comprises a continuous power source supplied by a topside source, an episodic power source supplied by a ship or a tanker, a power source supplied by a differential pressure between subsurface locations, or any combinations thereof.

28. The method of claim 12, wherein the cavern has a capacity of at least one million barrels.

29. A method for harvesting hydrocarbons, comprising:

flowing a hydrocarbon stream from a hydrocarbon reservoir directly to a salt cavern formed by solution mining;

performing a phase separation of the hydrocarbon stream within the salt cavern to recover a plurality of separated streams, wherein the plurality of separated streams comprise a liquid hydrocarbon stream, a gas stream, a water stream, and a solids stream;

injecting an amount of the gas stream directly back into the hydrocarbon reservoir at a first time;

injecting an amount of the water stream directly into an aquifer at a second time; and sending at least a portion of any of the plurality of separated streams to a new separate subsurface cavern through a subsurface line that does not reach the surface.

30. The method of claim 29, wherein the aquifer is fluidically coupled to the hydrocarbon reservoir.

31. The method of claim 29, comprising sending at least a portion of the liquid hydrocarbon stream or the gas stream, or both, to a location above surface, wherein the location above surface comprises a transportation system.

32. The method of claim 29, wherein sending at least a portion of any of the plurality of separated streams to the new subsurface location comprises sending at least a portion of the water stream or the gas stream, or both, to another cavern without reaching the surface for further separation or storage, or any combination thereof.

33. The method of claim 29, wherein the liquid hydrocarbon stream comprises oil or condensate.

* * * * *